US009354590B2

(12) United States Patent
Shima

(10) Patent No.: US 9,354,590 B2
(45) Date of Patent: May 31, 2016

(54) IMAGE FORMING APPARATUS

(71) Applicant: CANON KABUSHIKI KAISHA, Tokyo (JP)

(72) Inventor: Toshihide Shima, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/809,520

(22) Filed: Jul. 27, 2015

(65) Prior Publication Data

US 2016/0033926 A1 Feb. 4, 2016

(30) Foreign Application Priority Data

Jul. 30, 2014 (JP) ..... 2014-154601

(51) Int. Cl.

*G03G 21/00* (2006.01)
*G03G 21/12* (2006.01)
*G03G 21/10* (2006.01)

(52) U.S. Cl.

CPC ..... *G03G 21/0064* (2013.01); *G03G 21/12* (2013.01); *G03G 21/10* (2013.01); *G03G 2221/0052* (2013.01); *G03G 2221/0057* (2013.01)

(58) Field of Classification Search

CPC ... G03G 21/0064; G03G 21/10; G03G 21/12; G03G 2221/0052; G03G 2221/0057

See application file for complete search history.

(56) References Cited

U.S. PATENT DOCUMENTS

2012/0224883 A1* 9/2012 Okano ..... G03G 21/169 399/101
2014/0178095 A1* 6/2014 Souda ..... G03G 21/12 399/110

FOREIGN PATENT DOCUMENTS

JP H7-261617 A 10/1995
JP 2010-55127 A 3/2010

* cited by examiner

*Primary Examiner* — Joseph S Wong

(74) *Attorney, Agent, or Firm* — Fitzpatrick, Cella, Harper & Scinto

(57) ABSTRACT

An image forming apparatus includes a cassette provided drawably into/out of an apparatus body and storing recording media, a waste toner container being provided drawably into/out of the apparatus body along a pull-out direction of the cassette, a cover member movable between a close position where an opening portion enabling the waste toner container to be drawable into/pulled out of the apparatus body is closed and an open position where the opening portion is opened, and a moving portion. The moving portion engages with the cover member located at the open position and moves the cover member from the open position to the close position along with an insertion of the cassette into the apparatus body.

6 Claims, 9 Drawing Sheets

IMAGE FORMING APPARATUS

BACKGROUND OF THE INVENTION

1. Field of the Invention

The present invention relates to an image forming apparatus using an electro-photographic technology such as a printer, a copier, a facsimile, and a multi-function printer, and more specifically to an image forming apparatus including a cover member opening or shielding a storage portion drawably storing a toner recovery container.

2. Description of the Related Art

An image forming apparatus is provided with a toner recovery container recovering and reserving transfer residual toner scraped from an image carrier such as a photosensitive drum and an intermediate transfer belt by cleaning blades and deteriorated toner forcibly discharged out of a developing unit. The toner recovery container is provided drawably into/out of a body of the apparatus (referred to as an 'apparatus body' hereinafter) so that a user can pull the toner recovery container out of the apparatus body and replace with a new one.

For instance, Japanese Patent Application Laid-open No. Hei. 7-261617 discloses an image forming apparatus including an apparatus body provided with a storage portion storing the toner recovery container and the storage portion configured to be opened/closed (opened/shielded) by a cover member to prevent the recovered toner from scattering and a sensor detecting a quantity of the recovered toner from erroneously operating.

By the way, if a user keeps forgetting to close the storage portion after storing the toner recovery container into the storage portion, the storage portion is kept opened, possibly scattering the toner and causing erroneous operations of the toner quantity detecting sensor described above. In the apparatus described above, a part of a sheet cassette provided drawably into/out of the apparatus body functions also as a cover of the toner recovery container. Therefore, if the user inserts the sheet cassette while erroneously forgetting to close the storage portion, it becomes difficult for the user to close the storage portion by the cover member afterward because the part of the sheet cassette functioning also as the cover becomes obstructive. In such a case, the user has to pull out the inserted sheet cassette once just to close the storage portion by the cover member and to insert the sheet cassette again after closing the storage portion by the cover member. However, such works are time-consuming and troublesome.

SUMMARY OF THE INVENTION

According to one aspect of the invention, an image forming apparatus, including a cassette provided drawably into/out of an apparatus body and storing recording media, an image forming portion forming an image on the recording medium conveyed from the cassette, a waste toner container recovering toner discharged out of the image forming portion, the waste toner container being provided drawably into/out of the apparatus body along a pull-out direction of the cassette, a cover member movable between a close position where an opening portion enabling the waste toner container to be drawable into/pulled out of the apparatus body is closed and an open position where the opening portion is opened, and a moving portion engaging with the cover member located at the open position and moving the cover member from the open position to the close position along with an insertion of the cassette into the apparatus body.

Further features of the present invention will become apparent from the following description of exemplary embodiments with reference to the attached drawings.

DESCRIPTION OF THE EMBODIMENTS

First Embodiment

Figure 1:
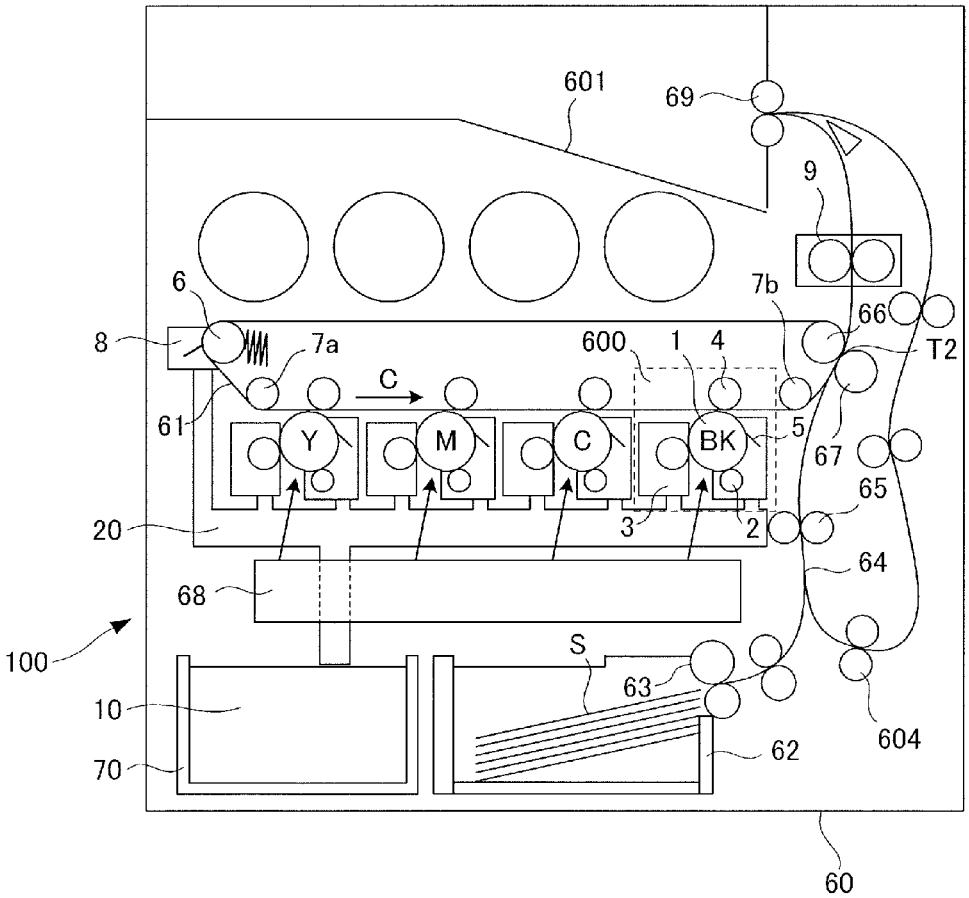
FIG. 1 is a schematic diagram illustrating a configuration of an image forming apparatus of a first embodiment.

An image forming apparatus of a first embodiment of the present invention will be described below with reference to FIGS. 1 through 6. FIG. 1 is a schematic diagram illustrating a configuration of the image forming apparatus, i.e., a color image forming apparatus using an electro-photographic system, of the first embodiment of the present invention. The image forming apparatus 100 illustrated in FIG. 1 is an intermediate transfer tandem type image forming apparatus in which four color image forming portions 600 are disposed to face an intermediate transfer belt 61 within an apparatus body 60.

<Image Forming Apparatus>

At first, a recording medium conveying process of the image forming apparatus 100 will be briefly described. A recording medium S is stored, while being stacked, within a sheet cassette 62 drawable into/out of the apparatus body 60 and is fed by a sheet feed roller 63 while coordinating with an image forming timing. The recording medium S is fed out of the sheet cassette 62 by using a friction separating system for example. The recording medium S delivered by the sheet feed roller 63 is conveyed to a registration roller 65 disposed on a way of a conveying path 64. Then, after correcting a skew of the recording medium S and timing, the recording medium S is sent to a secondary transfer portion T2. The secondary transfer portion T2 is a transfer nip portion composed of a secondary transfer inner roller 66 and a secondary transfer outer roller 67, facing with each other, and causes a toner image to be adsorbed onto the recording medium S by applying a predetermined pressurizing force and an electrostatic load bias.

An image forming process of the image sent to the secondary transfer portion T2 by the same timing with the conveying process of the recording medium S conveyed to the secondary transfer portion T2 as described above will be explained. While an image forming portion 600 will be explained, configurations of the image forming portions of the respective colors are basically the same other than the colors of toner, so that typically the image forming portion 600 of black (Bk) will be described below.

The image forming portion 600 is composed of a photosensitive drum 1, i.e., an image carrier, a charging unit 2, a developing unit 3, a primary transfer unit 4, a photosensitive drum cleaner 5, and others. A surface of the photosensitive drum 1 rotationally driven is homogeneously electrified by the charging unit 2 in advance, and then an electrostatic latent image is formed on the surface of the photosensitive drum 1 by an exposure unit 68 driven based on a signal of image information. Next, the electrostatic latent image formed on the photosensitive drum 1 is developed and visualized by the toner of the developing unit 3. Subsequently, the toner image formed on the photosensitive drum 1 is primarily transferred onto the intermediate transfer belt 61 by a predetermined pressure and an electrostatic load bias applied by the primary transfer unit 4 disposed to face the photosensitive drum 1 through the intermediate transfer belt 61. The photosensitive drum cleaner 5 removes primary transfer residual toner left on the photosensitive drum 1 after the primary transfer. The image forming apparatus 100 includes four sets of image forming portions 600 of yellow (Y), magenta (M), cyan (C), and black (Bk) in the case of the image forming apparatus shown in FIG. 1. However, a number of colors is not limited to be four, and the order of the colors is not also limited to what described above.

The intermediate transfer belt 61, i.e., an image carrier, is an endless belt stretched around a tension roller 6, a secondary transfer inner roller 66, and driven rollers 7*a* and 7*b* and is conveyed and driven in a direction of an arrow C in FIG. 1. Here, the secondary transfer inner roller 66 also functions as a drive roller driving the intermediate transfer belt 61. The image forming processes of the respective colors processed in parallel by the respective image forming portions 600 of Y, M, C, and Bk described above are carried out at timing of sequentially superimposing on an upstream color toner image primarily transferred onto the intermediate transfer belt 61. As a result, a full-color toner image is finally formed on the intermediate transfer belt 61 and is conveyed to the secondary transfer portion T2.

Through the conveying process and the image forming process described above, respectively, the recording medium S and the full-color toner image are timely coordinated in the secondary transfer portion T2 and the primary transfer is executed. A transfer cleaner unit 8 removes secondary transfer residual toner left on the intermediate transfer belt 61 after passing through the secondary transfer portion T2, i.e., after the secondary transfer. The recording medium S on which the toner image has been secondarily transferred is conveyed to a fixing unit 9 to receive a predetermined pressure and a quantity of heat to melt and fix the toner image onto the recording medium S. The recording medium S on which the toner image has been fixed is conveyed to a discharge roller 69 and, through a forward rotation thereof, is discharged onto a discharge tray 601.

The primary transfer residual toner removed by the photosensitive drum cleaner 5 and the secondary transfer residual toner removed by the transfer cleaner unit 8 (referred to as 'recovered toner' hereinafter for the sake of convenience) are sent to a conveying pipe 20 by a toner conveying screw not shown. One end of the conveying pipe 20 is connected to the photosensitive drum cleaner 5 and the transfer cleaner unit 8, and another end is connected to a toner recovery container 10.

A recovered toner conveying screw not shown is disposed within the conveying pipe 20 and the recovered toner sent into the conveying pipe 20 is conveyed within the conveying pipe 20 by the recovered toner conveying screw not shown to a toner recovery container 10 (referred to simply as a 'container' hereinafter). Thus, the transfer residual toner removed out of the photosensitive drum 1 and the intermediate transfer belt 61 is conveyed within the conveying pipe 20 and is collected within the container 10 as the recovered toner. It is noted that the developing unit 3 is also arranged such that toner deteriorated in the image forming process is forcibly discharged out of a developer container not shown. Then, the deteriorated toner forcibly discharged is conveyed through the conveying pipe 20 to the container 10 and is recovered within the container 10 in the same manner with the recovered toner described above.

The container 10 is provided drawably into/out of a storage portion 70 of the apparatus body 60. The storage portion 70 stores the container 10. Due to that, a space larger than size of the container 10 is assured for the storage portion 70 within the apparatus body 60. In FIG. 1, the container 10 is inserted into the storage portion 70 from a front side to a rear side of FIG. 1 and is pulled out of the rear side to the front side of FIG. 1. The sheet cassette 62 storing the recording medium S is provided horizontally with respect to the storage portion 70 and adjacent to the storage portion 70 so as to be drawable into/out of the apparatus body 60. Similarly to the container 10, the sheet cassette 62 is also arranged to be inserted from the front side to the rear side in FIG. 1 and is pulled out from the rear side to the front side in FIG. 1. That is, the drawing direction of the sheet cassette 62 is the same with the drawing direction of the container 10. The container 10 and the sheet cassette 62 are adjacent with each other within the apparatus body 60 by providing the storage portion 70 at the position adjacent the sheet cassette 62.

It is noted that a manipulation panel or the like not shown and manipulated by the user to operate the image forming apparatus 100 and to input an image forming job for example is provided on the front side in FIG. 1. That is, the front side of FIG. 1 corresponds to the front side of the image forming apparatus. Accordingly, the image forming apparatus 100 is a so-called front loading type apparatus in which the sheet cassette 62 and the container 10 are drawn out to the front side of the apparatus.

The storage portion 70 is provided with a toner quantity detecting sensor not shown and detecting whether or not a quantity of the recovered toner collected within the container 10 exceeds a predetermined quantity. If it is detected by the toner quantity detecting sensor that the quantity of the recovered toner collected within the container 10 exceeds the predetermined quantity, a message urging the user to replace the container 10 is displayed on the manipulation panel or the like not shown. Seeing the display, the user conducts operations of pulling the container 10 whose toner quantity has reached the predetermined quantity out of the apparatus body 60 and of inserting an empty container 10 prepared in advance instead of the pulled out container 10. The container 10 is thus replaced with the empty container.

Figure 3A:
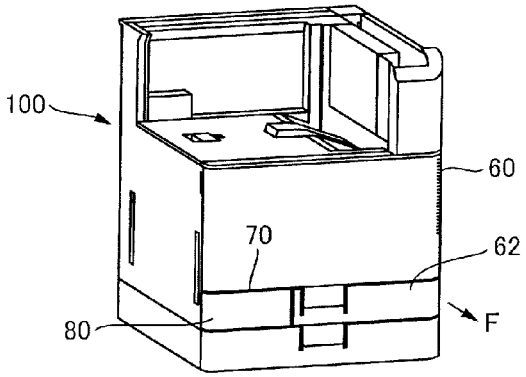
FIG. 3A illustrates the image forming apparatus in a state in which a sheet cassette and the toner recovery container are inserted into the apparatus body.

It is noted that although not shown here, a cover member 80 is provided at an apparatus front side entrance of the storage portion 70 (see FIG. 3A for example). As described later in detail, the cover member 80 is provided turnably between an open position opening the storage portion 70 and a shield position (close position) shielding the storage portion 70.

<Toner Recovery Container>

Figure 2A:
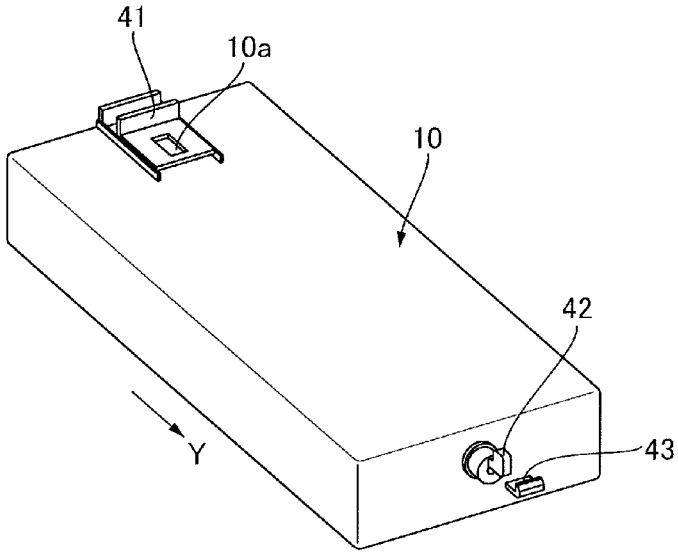
FIG. 2A is a perspective view illustrating a toner recovery container of the first embodiment.

The container 10 will now be described with reference to FIGS. 2A and 2B. FIG. 2A is a perspective view illustrating an outside appearance of the container 10 and FIG. 2B is a side section view illustrating a section along an insert direction of the container 10.

The container 10 is formed into a rectangular shape as shown in FIG. 2A by using resin such as soft plastic for example. The container 10 includes an opening 10*a*. The opening 10*a* is provided at a predetermined position on an upper surface of the container 10 and at upstream in the insert direction (in a direction of arrow Y in FIG. 2A) such that the opening 10*a* is positioned at a position facing the end of the conveying pipe 20, i.e., a side thereof where the recovered toner flows out, when the container 10 is inserted into the storage portion 70.

The opening 10*a* is provided with a shutter 41 opened/closed in linkage with the insertion of the container 10 into the storage portion 70. The shutter 41 is configured to open the opening 10*a* when the container 10 is inserted into the storage portion 70 and to close the opening 10*a* when the container 10 is pulled out of the storage portion 70. That is, when the container 10 is inserted deeply into the storage portion 70, the opening 10*a* is opened, allowing the recovered toner to be recovered into the container 10 through the conveying pipe 20 connected to the opening 10*a*. When the container 10 is pulled out of the storage portion 70 on the other hand, the opening 10*a* is closed, allowing the container 10 to keep the recovered toner therein.

Figure 2B:
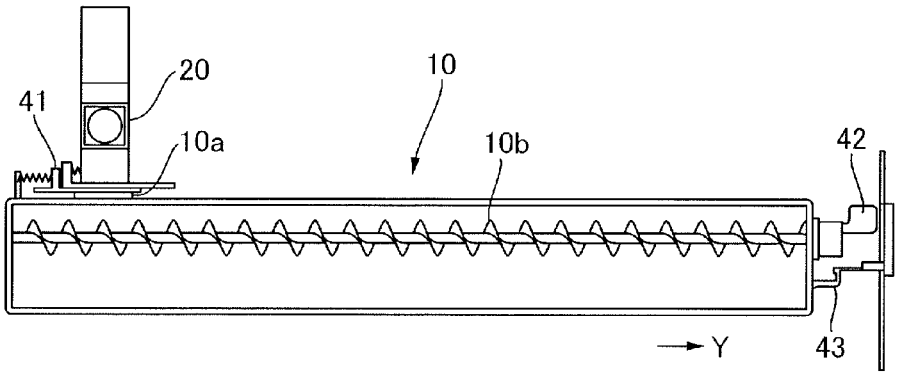
FIG. 2B is a section view of the toner recovery container shown in FIG. 2A.

The container 10 is also provided with a recovered toner conveying screw 10*b* therein as shown in FIG. 2B. The recovered toner conveying screw 10*b* is formed by using resin such as plastic and is axially supported at longitudinal both ends, i.e., in the drawing direction, of the container 10 so as to be substantially horizontally and to be rotable. However, an axial end part of the screw 10*b* is axially supported so as to project out of the container 10 downstream in the insert direction (in the direction of the arrow A in FIG. 2B) of the container 10. Then, a drive connecting portion 42 is attached to the axial end part of the recovered toner conveying screw 10*b* projecting out of the container 10. When the container 10 is inserted into the storage portion 70, the drive connecting portion 42 is linked with a driving source such as a motor not shown provided within the apparatus body 60 to transmit a rotational driving force generated by the driving source to the recovered toner conveying screw 10*b*. That is, the recovered toner conveying screw 10*b* is arranged to be rotationally driven by the driving source provided within the apparatus body 60.

As described above, the image forming apparatus 100 is arranged such that the sheet cassette 62 and the container 10 are both inserted into the apparatus body 60 in the same direction. Here, the drawing procedure of the container 10 in the image forming apparatus 100 will be described with reference to FIGS. 3A through 3D.

FIG. 3A illustrates a state in which the sheet cassette 62 and the container 10 are inserted into the apparatus body 60. The image forming apparatus 100 executes an image forming job only when the sheet cassette 62 and the container 10 are both inserted into the apparatus body 60. In other words, the image forming apparatus 100 will execute no image forming job if at least either one of the sheet cassette 62 and the container 10 is pulled out (not inserted) of the apparatus body 60. The cover member 80 is located at the shield position and the storage portion 70 is closed in the state in which the container 10 is inserted into the apparatus body 60.

Figure 3B:
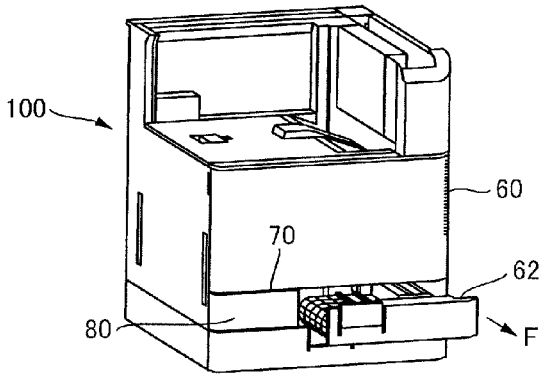
FIG. 3B illustrates the image forming apparatus in a state in which the sheet cassette is pulled out from the apparatus body.

FIG. 3B illustrates a state in which the sheet cassette 62 is pulled out from the state shown in FIG. 3A. As shown in FIG. 3B, the user can pull out the sheet cassette 62 to the front side of the apparatus (in a direction of an arrow F here). The user can replenish recording media into the sheet cassette 62 for example by pulling the sheet cassette 62 out of the apparatus body 60. As it is apparent by comparing FIGS. 3A and 3B, the cover member 80 is not turned to the open position and is held at the shield position even if the sheet cassette 62 is pulled out of the apparatus body 60. Therefore, in order to pull the container 10 out of the storage portion 70, the user is required to manually turn the cover member 80 from the shield position to the open position to open the storage portion 70. Thus, the image forming apparatus 100 is arranged such that the cover member 80 is turned from the shield position to the open position manually by the user.

Figure 3C:
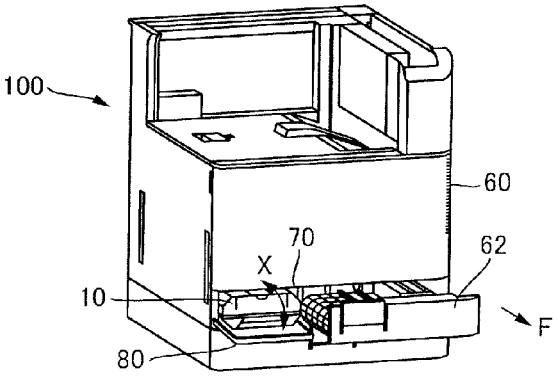
FIG. 3C illustrates the image forming apparatus in a state in which a cover member is located at an open position.
Figure 3D:
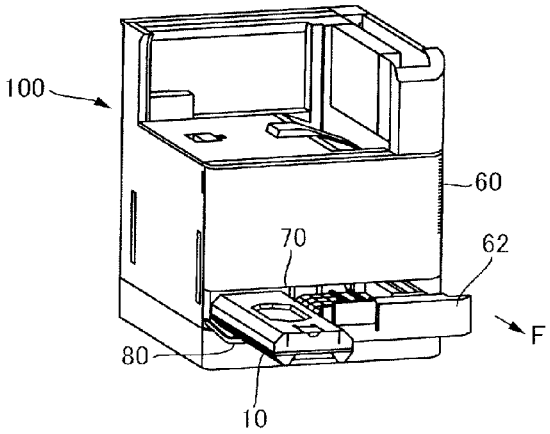
FIG. 3D illustrates the image forming apparatus in a state in which the toner recovery container is pulled out of the storage portion.

FIG. 3C illustrates a state in which the cover member 80 is located at the open position, i.e., the storage portion 70 is opened. FIG. 3D illustrates a state in which the container 10 is pulled out of the storage portion 70. As shown in FIG. 3C, the image forming apparatus 100 is arranged such that a turning shaft of the cover member 80 is disposed at a lower end part of the cover member 80 such that the cover member 80 turns in a direction of an arrow X in FIG. 3C and such that an upper end part, i.e., an end part in a direction opposite from the direction of the gravity, of the cover member 80 comes into contact with and separates from the apparatus body 60. The user can pull the container 10 out of the storage portion 70 to the front side of the apparatus (in the direction of the arrow F in FIG. 3D) as shown in FIG. 3D after turning the cover member 80 to the open position. At this time, the cover member 80 supports a bottom surface of the pulled-out container 10 and functions also as a guide. That is, the user can pull the container 10 out of the storage portion 70 while confirming how much of the container 10 is left within the storage portion 70 by viewing the relative positional relationship between the cover member 80 and the pull-out container 10.

The sheet cassette 62 and the container 10 can be inserted into the apparatus body 60 by reversely executing the procedure described above. That is, firstly the user inserts the container 10 into the storage portion 70 and then inserts the sheet cassette 62 into the apparatus body 60. At this time, the cover member 80 is turned from the open position to the shield position in linkage with the insertion of the sheet cassette 62 in the image forming apparatus 100. That is, while the user is required to manually turn the cover member 80 from the shield position to the open position, the image forming apparatus 100 is arranged such that the user is not required to manually turn the cover member 80 from the open position to the shield position. Therefore, as the user inserts the sheet cassette 62, the cover member 80 is automatically turned from the open position to the shield position, and when the sheet cassette 62 is inserted into the apparatus body 60, the state shown in FIG. 3A is brought about in the end.

Figure 4:
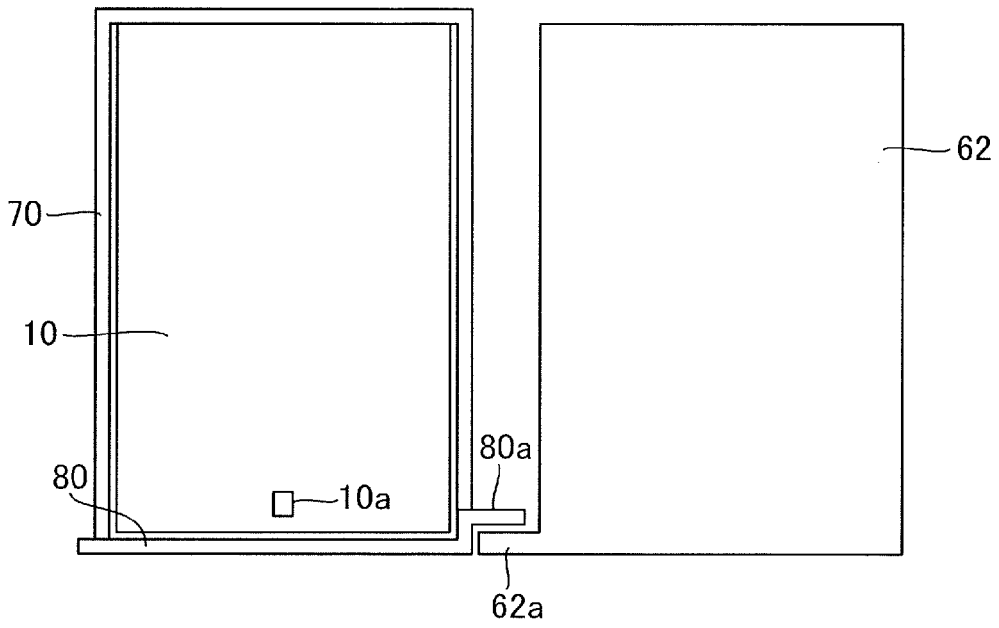
FIG. 4 is a section view of the sheet cassette and the toner recovery container of the first embodiment seen from above.

By the way, the cover member 80 and the sheet cassette 62 are formed respectively such that a part of the cover member 80 overlaps with a part of the sheet cassette 62 in the image forming apparatus 100. As shown in FIG. 4, the cover member 80 includes a cover projecting portion 80*a* projecting to the sheet cassette 62 side, and the sheet cassette 62 includes a cassette projecting portion 62*a* projecting to the cover member 80 side (the cover member side). These cassette projecting portion 62*a* and cover projecting portion 80*a* are provided respectively such that the cassette projecting portion 62*a* is positioned on the apparatus front side more than the cover projecting portion 80*a* in a state in which the sheet cassette 62 and the container 10 are both inserted into the apparatus body 60 (see FIG. 3A). In the image forming apparatus 100, the cover projecting portion 80*a* is formed into a shape of crank by bending the cover member 80 once in the insert direction and then to the sheet cassette 62 side.

The cassette projecting portion 62*a*, i.e., the projecting portion, engages with the cover projecting portion 80*a* at the apparatus front side in the state in which the sheet cassette 62 and the container 10 are inserted into the apparatus body 60. Thereby, the user is unable to turn the cover member 80 from the shield position to the open position unless the user previously pulls out the sheet cassette 62. The container 10 cannot be pulled out of the storage portion 70 if the cover member 80 cannot be turned from the shield position to the open position. Thus, the cassette projecting portion 62*a* projects to the cover member 80 side in the state in which the sheet cassette 62 is inserted into the apparatus body 60 and indirectly obstructs the container 10 from being pulled out.

It is because when a replacing interval of the container 10 is compared with a sheet replenishing interval of the sheet cassette 62, the sheet replenishing interval of the sheet cassette 62 is shorter, and the sheet cassette 62 is more frequently pulled out. Therefore, there may be a case where the user erroneously pulls out the container 10, not the sheet cassette 62, in replenishing the sheets in a configuration in which the cover member 80 is turnable even though the sheet cassette 62 is not previously pulled out. In such a case, toner is liable to scatter from a joint portion or the like between the container 10 and the conveying pipe 20 (see FIG. 1). In order to prevent this trouble from occurring, the container 10 must be able to be pulled out in a state in which the sheet cassette 62 is pulled out. Then, the arrangement is made such that the user cannot pull out the container 10 unless the user previously pulls out the sheet cassette 62 because the cassette projecting portion 62*a* obstructs the container 10 from being pulled out indirectly through the cover member 80.

As described above, the image forming apparatus 100 is arranged such that the cover member 80 is turned from the open position to the shield position along with the insertion of the sheet cassette 62. Then, a mechanism for turning the cover member 80 will be described with reference to FIGS. 5 and 6A through 6F. It is noted that FIG. 5 illustrates a state in which the cover member 80 is located at the open position to make the description readily understood.

Figure 5:
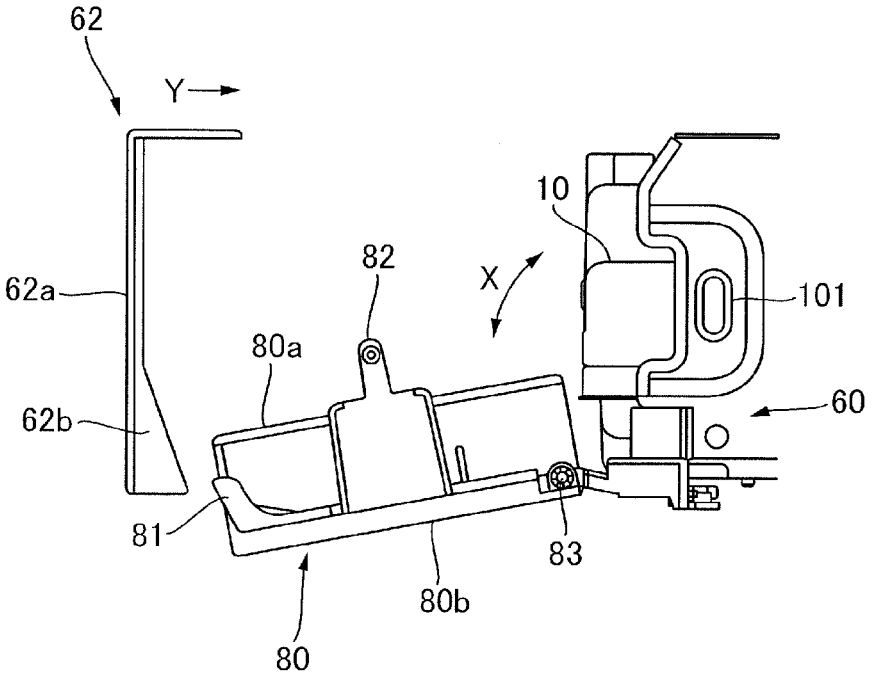
FIG. 5 is a sectional side view illustrating a turning mechanism of the cover member exerted by the sheet cassette of the first embodiment.

As shown in FIG. 5, the cassette projecting portion 62*a* is provided with an engage member 62*b*, i.e., an engage portion (moving portion) in the sheet cassette 62. The engage member 62*b* is provided on a side facing to the cover projecting portion 80*a* of the sheet cassette 62. The engage member 62*b* is formed into a shape having an inclined guide surface, i.e., a guide portion.

Meanwhile, the cover member 80 includes a guide member 81, i.e., a guide portion, in the cover projecting portion 80*a*. The guide member 81 is provided at a position facing the engage member 62*b* of the sheet cassette 62 and engages with the engage member 62*b* when the sheet cassette 62 is inserted. Still further, the cover member 80 is supported turnably to the apparatus body 60 through a turning shaft 83 and is turnable in a direction of an arrow X in FIG. 5 centering on the turning shaft 83. In the image forming apparatus 100, the turning shaft 83 is disposed in a direction intersecting with the direction in which the container 10 is inserted into/pulled out and in a same direction (direction perpendicular to a sheet surface in FIG. 5) with the sheet cassette 62 juxtaposed in a horizontal direction. Therefore, the cover member 80 turns such that a left hand side thereof comes into contact with and separates from the apparatus body 60 in FIG. 5. Still further, the cover member 80 includes a locking hook 82 as a holding portion. The locking hook 82 is composed of an elastic member and erects vertically to a cover portion 80*b* of the cover member 80 covering the storage portion 70. A convex portion projecting in a direction perpendicular to the sheet surface of FIG. 5 is formed at a tip of the locking hook 82.

Figure 6A:
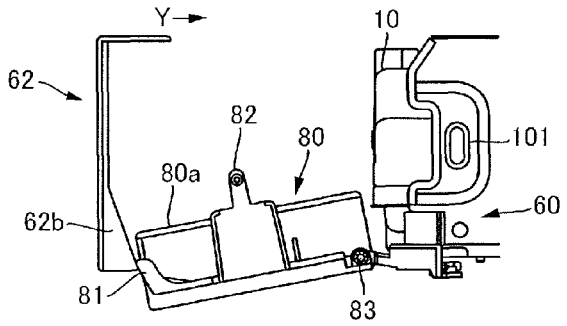
FIG. 6A illustrates the cover member in a state in which an engage member starts to engage with a guide member of the cover member.
Figure 6D:
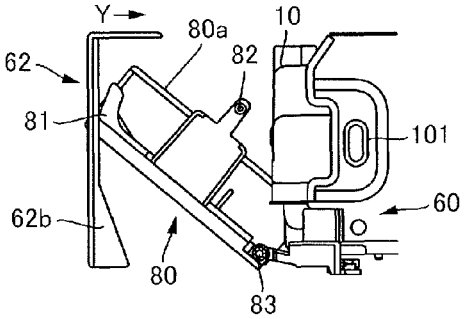
FIG. 6D illustrates the cover member in a state in which the cover member is guided further along the guide face of the engage member from the state shown in FIG. 6C.
Figure 6B:
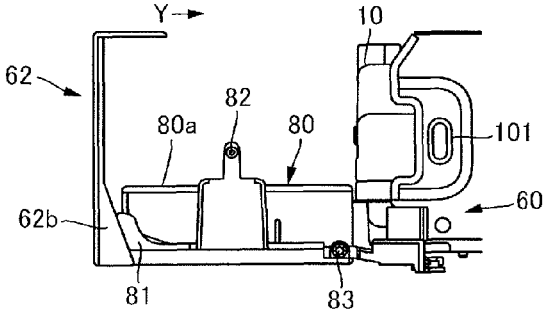
FIG. 6B illustrates the cover member in a state in which the cover member is guided along a guide face of the engage member according to an insertion of the sheet cassette.
Figure 6E:
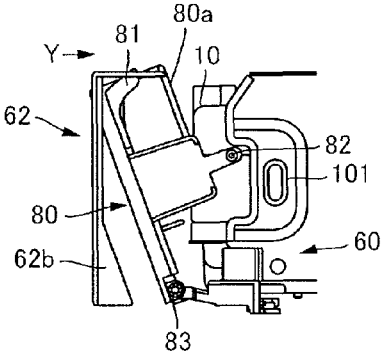
FIG. 6E illustrates a still further state in which the cover member is guided further along the guide face of the engage member from the state shown in FIG. 6D.
Figure 6C:
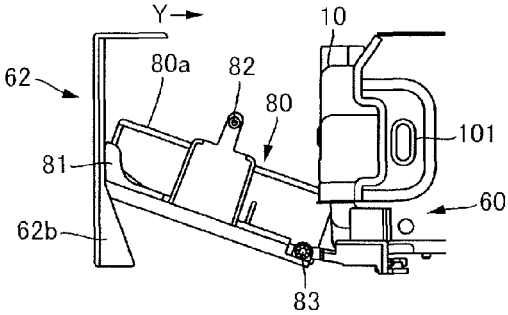
FIG. 6C illustrates the cover member in a state in which the cover member is guided further along the guide face of the engage member from the state shown in FIG. 6B.

Next, the turning operation of the cover member 80 in the image forming apparatus 100 will be described with reference to FIGS. 6A through 6F. As shown in FIG. 6A, when the sheet cassette 62 is started to be inserted in a direction of an arrow Y, the engage member 62*b* starts to engage with the guide member 81 of the cover member 80. Then, the cover member 80 is guided along the guide surface of the engage member 62*b* in the state in which the engage member 62*b* engages with the guide member 81 along with the insertion of the sheet cassette 62 as shown in FIGS. 6B through 6F. Thus, the cover member 80 turns centering on the turning shaft 83.

Figure 6F:
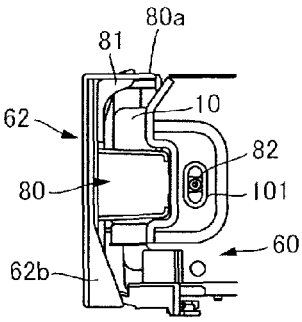
FIG. 6F illustrates the cover member in a state in which the cover member reaches the shield position.

A moving distance of the guide member 81 on the guide surface of the engage member 62*b* increases in proportion to an intrusion amount of the sheet cassette 62 into the apparatus body 60. That is, as the sheet cassette 62 enters deeply into the apparatus body 60, the moving distance of the guide member 81 on the guide face of the engage member 62*b* increases, so that the cover member 80 can be turned from the open position to the shield position. When the cover member 80 reaches the shield position as shown in FIG. 6F, the locking hook 82 is locked by a lock portion 101 provided in the apparatus body 60. Specifically, the convex portion at the tip of the locking hook 82 is elastically deformed toward a side of the lock portion 101 and fitted into the lock portion 101. Due to the lock of the locking hook 82, the cover member 80 is held in the shield position, i.e., in the state in which the storage portion 70 is closed. This state is held even in a non-attachment state in which the sheet cassette 62 is pulled out of the apparatus body 60. The user himself/herself has to unlock the locking hook 82 in order to turn the cover member 80 from the shield position to the open position. That is, the cover member 80 can be turned from the shield position to the open position only manually by the user.

As described above, the engage member 62*b* engaging with the cover member 80 (more specifically with the guide member 81) is provided in the sheet cassette 62 and the engage member 62*b* is arranged to turn the cover member 80 from the open position to the shield position along with the insertion of the sheet cassette 62 into the apparatus body 60. That is, along with the insertion of the sheet cassette 62 into the apparatus body 60, the engage member 62*b* engages with the cover member 80. Then, when the sheet cassette 62 is inserted further, the engage member 62*b* guides the cover member 80 along the guide face along with the insertion. At this time, the cover member 80 is guided so as to turn from the shield position to the open position. Thus, when the sheet cassette 62 is inserted into the apparatus body 60, the cover member 80 becomes operative and closes the storage portion 70 in linkage with the insertion of the sheet cassette 62 even if the storage portion 70 is not closed. Thereby, the storage portion 70 will not be kept opened by being forgotten to be closed, so that the toner hardly scatters out of the storage portion 70 and erroneous operations of the toner quantity detecting sensor hardly occur. Still further, these advantageous effects are brought about just by inserting the sheet cassette 62, so that it is excellent in operability and is convenient for the user.

Second Embodiment

Figure 7:
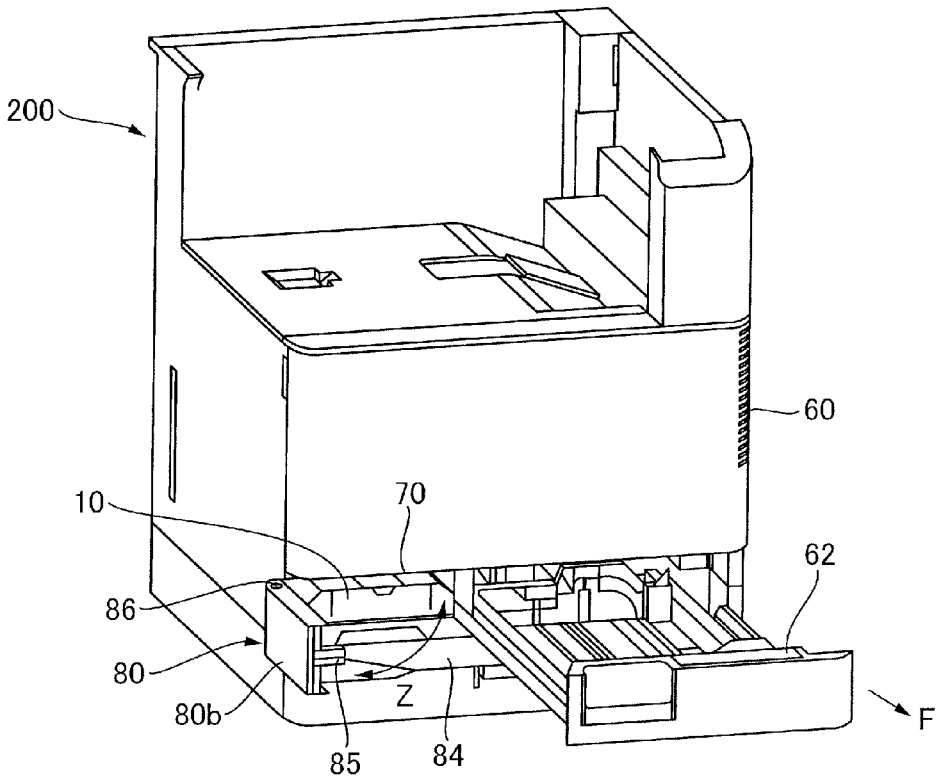
FIG. 7 is a perspective view illustrating an outside appearance of an image forming apparatus of a second embodiment of the invention.
Figure 8:
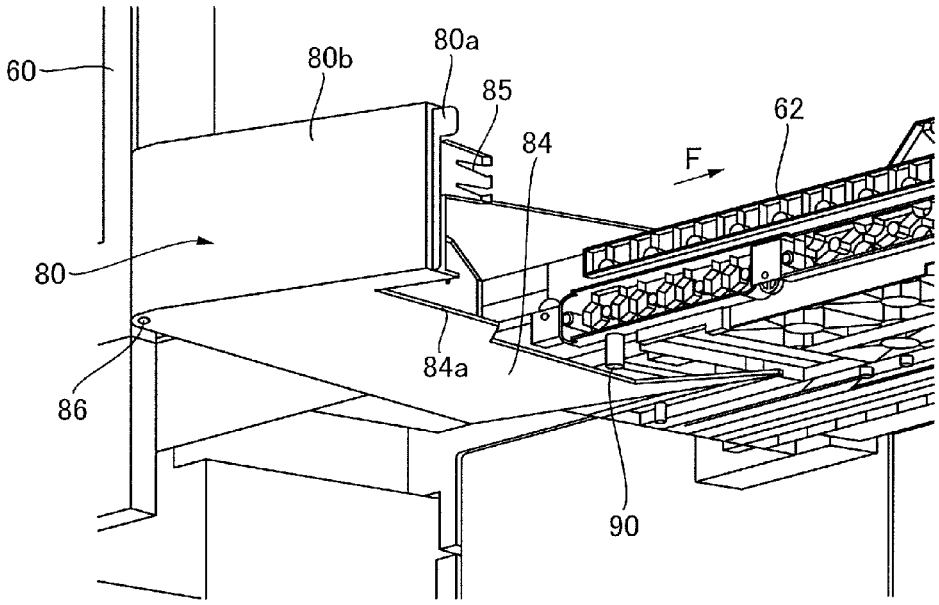
FIG. 8 is a perspective view viewed from a lower left direction and illustrating a turning mechanism of the cover member of the second embodiment exerted by the sheet cassette.

An image forming apparatus of a second embodiment of the invention will be described with reference to FIGS. 7 through 9. FIG. 7 is a perspective view illustrating an outside appearance of the image forming apparatus of the second embodiment of the invention. It is noted that FIG. 7 illustrates a state in which the sheet cassette 62 is pulled out and the cover member 80 is located at the open position for the convenience of the description. The image forming apparatus 200 illustrated here is largely different from the image forming apparatus 100 described above and having the vertical opening type cover member 80 in that the image forming apparatus 200 includes a horizontally opening type cover member 80. It is noted that while the image forming apparatus 200 also includes a large number of structural elements forming the image forming apparatus such as the image forming units and the fixing unit shown in FIG. 1 in the apparatus body 60, they are not main elements of the present invention, so that their illustration and description will be omitted here.

As shown in FIG. 7, the cover member 80 is configured to be turnably supported by the apparatus body 60 through the turning shaft 86 and to be turnable centering on the turning shaft 86 in a direction of an arrow Z in FIG. 7. In the image forming apparatus 200, the turning shaft 86 is disposed at a side edge part of the cover member 80 distant from the sheet cassette 62 in a direction intersecting with the direction in which the container 10 is inserted/pulled out and in a direction perpendicular to the sheet cassette 62 juxtaposed in the horizontal direction (in the vertical direction in FIG. 7). Due to that, the cover member 80 turns such that a side edge part on a right hand side in FIG. 7 (the side closer to the sheet cassette 62) comes into contact with and separates from the apparatus body 60. Still further, the cover member 80 includes a locking hook 85, i.e., a holding portion, at the side edge part of the cover member 80 closer to the sheet cassette 62. The locking hook 85 is formed of an elastic member and erects vertically to the cover portion 80*b* of the cover member 80 covering the storage portion 70.

The cover member 80 includes the cover portion 80*b* covering the storage portion 70 at the shield position and a plate member 84, i.e., a plate portion. The cover portion 80*b* and the plate member 84 are formed integrally and substantially into a shape of letter of 'L'. As shown in FIG. 8, the plate member 84 is provided at a lower edge of the cover portion 80*b* so as to project horizontally from the cover portion 80*b* to the sheet cassette 62 side at the open position. Meanwhile, the sheet cassette 62 includes a projecting portion 90, i.e., an engage portion. The projecting portion 90 is provided so as to project in a perpendicular direction (in a lower direction in FIG. 8) so as to intersect with the plate member 84 from a bottom face supporting the recording medium in the sheet cassette 62. The plate member 84 engages with the projecting portion 90 along with the insertion of the sheet cassette 62. An edge portion 84*a* of the plate member 84 is formed into a shape of engaging with the projecting portion 90 and turning the cover member 80. That is, in the image forming apparatus 200 of the present embodiment, the edge portion 84*a* of the plate member 84 engaging with the projecting portion 90 functions as a guide portion.

Figure 9A:
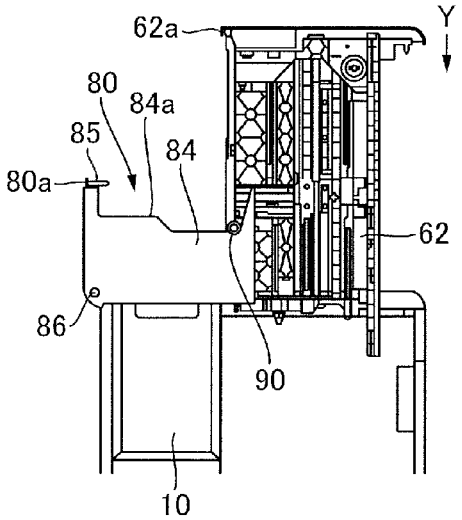
FIG. 9A illustrates the cover member of the second embodiment located at the open position.
Figure 9B:
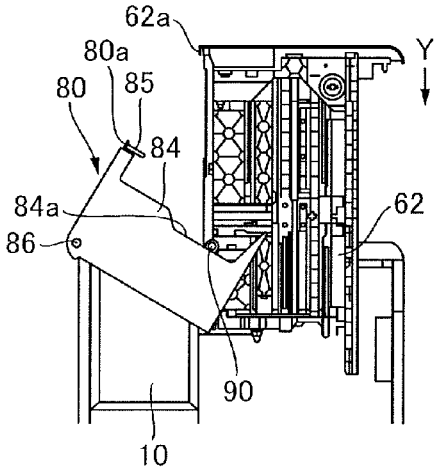
FIG. 9B illustrates the cover member in a state in which the cover member is guided along an edge portion of a plate member.
Figure 9C:
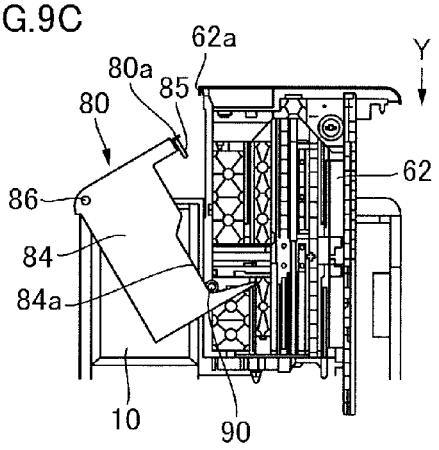
FIG. 9C illustrates the cover member in a state in which the cover member is guided further along the edge portion of the plate member from the state shown in FIG. 9B.
Figure 9D:
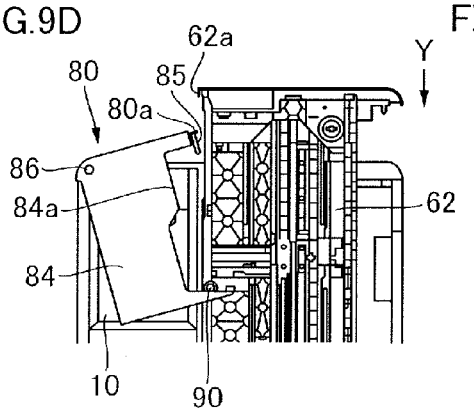
FIG. 9D illustrates the cover member in a state in which the cover member is guided further along the edge portion of the plate member from the state shown in FIG. 9C.
Figure 9E:
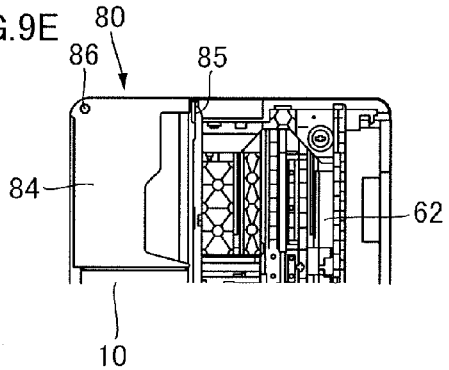
FIG. 9E illustrates the cover member in a state in which the cover member reaches the shield position.

A turning operation of the cover member 80 in the image forming apparatus 200 will be described with reference to FIGS. 9A through 9E. As shown in FIG. 9A, when the sheet cassette 62 is started to be inserted in a direction of an arrow Y in FIG. 9A, the projecting portion 90 engages with the plate member 84 (more specifically, the edge portion 84*a*). Then, as shown in FIGS. 9B through 9E, the cover member 80 is guided along the edge portion 84*a* (guide portion) of the plate member 84 in the state in which the projecting portion 90 is kept engaged with the plate member 84 along with the insertion of the sheet cassette 62. Thus, the cover member 80 turns centering on the turning shaft 86. At this time, as the sheet cassette 62 enters deeply into the apparatus body 60, a turning angle of the cover member 80 increases and the cover member 80 can be turns from the open position to the shield position. Then, as shown in FIG. 9E, when the cover member 80 reaches the shield position, the locking hook 85 is locked by the lock portion provided at the apparatus body 60 and not shown, and the cover member 80 is held at the shield position, i.e., in the state in which the storage portion 70 is closed. The user himself/herself has to unlock the locking hook 85 in order to turn the cover member 80 from the shield position to the open position also in the image forming apparatus 200 of the present embodiment. That is, the cover member 80 can be turned from the shield position to the open position only manually by the user.

The cover member 80 includes a cover projecting portion 80*a* projecting to the sheet cassette 62 side and the sheet cassette 62 includes a cassette projecting portion 62*a* projecting to the cover member 80 side also in the image forming apparatus 200 of the present embodiment. Then, the cassette projecting portion 62*a*, i.e., the projecting portion, is engaged with the cover projecting portion 80*a* at the apparatus front side in the state in which the sheet cassette 62 and the container 10 are inserted into the apparatus body 60. Thereby, it is unable to turn the cover member 80 from the shield position to the open position unless the user previously pulls out the sheet cassette 62.

Thus, in the image forming apparatus 200, as the sheet cassette 62 is inserted into the apparatus body 60, the projecting portion 90 of the sheet cassette 62 engages with the plate member 84 (more specifically the edge portion 84*a*) of the cover member 80. Then, along with the insertion of the sheet cassette 62, the projecting portion 90 and the plate member 84 cooperate and turn the cover member 80 from the open position to the shield position. This arrangement brings about the same effect with the image forming apparatus 100 of the first embodiment. That is, the storage portion 70 will not be kept opened by being forgotten to be closed, so that the toner hardly scatter out of the storage portion 70 and the toner quantity detecting sensor hardly causes erroneous operation. Still further, it is excellent in operability and convenient for the user because those effects are brought about just by inserting the sheet cassette 62.

Still further, the plate member 84 of the cover member 80 supports a bottom face of the pulled-out container 10 at the open position and functions also as a guide in the image forming apparatus 200 of the present embodiment. That is, the user can pull the container 10 out of the storage portion 70 while confirming how much of the container 10 is stored within the storage portion 70.

It is noted that the image forming apparatus 200 may be arranged such that the cover member 80 cannot be turned from the shield position to the open position without providing the cover projecting portion 80*a* and the cassette projecting portion 62*a*. For instance, the edge portion 84*a* of the plate member 84 may be formed into a shape by which the cover member 80 cannot be moved to the open position in the state in which the sheet cassette 62 is not pulled out while keeping the projecting portion 90 to be engaged with the plate member 84 when the cover member 80 is located at the shield position. Specifically, when the cover member 80 is located at the shield position, the edge portion 84*a* of the plate member 84 may be formed to project to the sheet cassette 62 side such that the projecting portion 90 engages with the plate member 84 in the state in which the projecting portion 90 is located at the apparatus front side.

It is noted that while the cover member 80 is held at the shield position, i.e., in the state in which the storage portion 70 is closed, by locking the locking hooks 82 and 85 composed of the elastic member in the respective embodiments described above, the present invention is not limited to such configurations. For example, a magnetic member such as magnet may be used instead of the locking hooks 82 and 85.

Still further, while the image forming apparatus configured to secondarily transfer composite toner images of the respective colors collectively on the recording medium S after primarily transferring the toner images of respective colors from the photosensitive drums 1 of the respective colors onto the intermediate transfer belt 61 has been described in the embodiments described above, the present invention is not limited to such configuration. For instance, the image forming apparatus may be a direct transfer type image forming apparatus in which toner images are transferred directly from the photosensitive drums to the recording medium.

According to the present invention, the cassette is provided with the engage portion engaging with part of the cover member, and the engage portion turns the cover member from the open position to the shield position along with the insertion of the cassette into the apparatus body. That is, even if the storage portion is not closed by the cover member, the cover member closes the storage portion in linkage with the insertion of the cassette into the apparatus body. Thus, the storage portion is closed when the cassette is inserted into the apparatus body, the storage portion is not kept opened by being forgotten to be closed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-154601, filed on Jul. 30, 2014, which is hereby incorporated by reference herein in its entirety.

What is claimed is:

1. An image forming apparatus, comprising:

a cassette provided drawably into/out of an apparatus body and storing a recording medium;

an image forming portion forming an image on the recording medium conveyed from the cassette;

a waste toner container recovering toner discharged out of the image forming portion, the waste toner container being provided drawably into/out of the apparatus body along a pull-out direction of the cassette;

a cover member movable between a close position where an opening portion enabling the waste toner container to be drawable into/pulled out of the apparatus body is closed and an open position where the opening portion is opened; and a moving portion engaging with the cover member located at the open position and moving the cover member from the open position to the close position along with an insertion of the cassette into the apparatus body.

2. The image forming apparatus according to claim 1, wherein the cover member is provided turnably on the apparatus body and at least one of the moving portion or the cover member is provided with a guide portion turning the cover member along with the insertion of the cassette into the apparatus body.

3. The image forming apparatus according to claim 1, wherein the cover member is provided turnably centering on a turning shaft provided in a direction intersecting with a direction in which the waste toner container is inserted/pulled out.

4. The image forming apparatus according to claim 3, wherein the cassette is juxtaposed horizontally with a storage portion for the waste toner container and turning shaft is disposed in a horizontal direction.

5. The image forming apparatus according to claim 4, wherein the cassette includes a projecting portion projecting to a cover member side so as to obstruct the waste toner container from being pulled out of the apparatus body in a state in which the cassette is inserted into the apparatus body, and wherein the moving portion is provided in the projection portion.

6. The image forming apparatus according to claim 1, further comprising a hold portion holding the cover member at the close position in a state in which the cassette is pulled out of the apparatus body.

* * * * *